US006098605A

United States Patent [19]

Brooks

[11] Patent Number: 6,098,605

[45] Date of Patent: Aug. 8, 2000

[54] METHOD AND APPARATUS FOR OPERATION OF AN INTERNAL COMBUSTION ENGINE IN A TRUE CLOSED LOOP FUEL CONTROL

[75] Inventor: Timothy J. Brooks, Troy, Mich.

[73] Assignee: TJB Engineering, Inc., Troy, Mich.

[21] Appl. No.: 09/235,070

[22] Filed: Jan. 21, 1999

[51] Int. Cl.[7] ..... F02D 41/14; F02D 41/18; F02D 41/16

[52] U.S. Cl. ..... 123/680; 123/681; 123/704

[58] Field of Search ..... 123/681, 704, 123/680

[56] References Cited

U.S. PATENT DOCUMENTS

| | | | |
|---|---|---|---|
| 4,619,237 | 10/1986 | Auslander et al. . | |
| 4,924,837 | 5/1990 | Chujo et al. | 123/704 |
| 5,564,406 | 10/1996 | Klein | 123/681 |
| 5,613,480 | 3/1997 | Katoh et al. | 123/681 |
| 5,685,283 | 11/1997 | Nishioka et al. | 123/681 |
| 5,755,212 | 5/1998 | Ajima | 123/674 |
| 5,931,144 | 8/1999 | Firey | 123/681 |

*Primary Examiner*—Erick R. Solis
*Attorney, Agent, or Firm*—Gifford, Krass, Groh, Sprinkle, Anderson & Citkowski, P.C.

[57] ABSTRACT

A true closed-loop air/fuel ratio control system for an internal combustion engine which uses a cylinder air charge percentage value also known as a cylinder or engine load value, is used to control the air/fuel ratio of said engine in response to the difference of said measured load value and a predetermined optimum load value. This process allows true closed-loop fuel control immediately following a cold or warm engine start without need of a traditional exhaust gas sensor. As this process automatically compensates for all fuel utilized by the engine, even during cold starting and idles, the problems associated with fuel vapor purge systems are eliminated. This process can reduce government regulated emissions from said engine considerably and improve fuel economy a significant percentage particularly when operated net lean of stoichiometric. Elimination of currently required engine hardware for traditional systems can allow for a considerable cost savings. The process allows for a significant calibration and control robustness increase without compromising emissions or causing an operational instability. The second mathematical derivative of the command control function is utilized to determine the control stability of operation with the corrections to the target load values. These values are then updated accordingly. Other modes of operation allow this use in special situations or in alternative conditions.

19 Claims, 4 Drawing Sheets

Learn Mode

METHOD AND APPARATUS FOR OPERATION OF AN INTERNAL COMBUSTION ENGINE IN A TRUE CLOSED LOOP FUEL CONTROL

BACKGROUND OF THE INVENTION

1. Field of the Invention

This invention relates to a method and apparatus that will allow an engine to operate closed-loop in a desired air/fuel controlled—enleanment condition following a cold or warm start, highway cruise or other general dynamic operational condition. The method and system of the present invention will optimize air/fuel control for each individual vehicle or engine.

2. Description of the Prior Art

The operation of an internal combustion engine in an enleaned condition has been significantly elusive because a true feedback system is required to anticipate any conditions other than those for which an engine was originally configured and calibrated for. True feedback systems have been less than satisfactory because they generally rely on heated exhaust gas oxygen sensors (HEGO) or heated universal exhaust gas oxygen sensors (UEGO), which take a significant period of time to become operational and which are subject to damage or chemical poisons which cause improper signal outputs. These sensors have other problems such as a propensity to have a sluggish response when the sensors are subjected to a large mass of chemical reactants or when cold. These sensors also have a limited life span and are not useful in some applications.

An internal combustion engine, when started cold or even hot, does not have perfect fuel utilization. An excess of fuel is generally introduced into the intake system to insure that a good igniting and burning of the air/fuel mixture is maintained. The excessive fuel introduced into the system is almost impossible to quantify and control due to a number of reasons such as actual fuel composition, such as RVP (Reeds Vapor Pressure), and variable engine operational condition(s). Engine intake deposits, which change over time, also play a significant role in the proper fueling of said engines. Generally most of the regulated emissions emitted into the atmosphere by vehicles are produced during this period of engine operation, that is, during the first 30 to 90 seconds after cold (or warm) engine start. This is the period that the engine usually operates "open-loop". This means that a closed-loop feed-back process is not employed to optimize the engine running conditions to minimize regulated emissions. Thus, it is quite desirable to employ a closed-loop control process to assure properly controlled engine operation at the leanest condition without the fear of a stall or misfire from operating too lean.

One known prior art approach to starting an internal combustion engine cold is disclosed in U.S. Pat. No. 4,619,237, issued Oct. 28, 1986 to Auslander et al. Here, a predetermined optimum engine speed in rotations per minute (RPM) is initially maintained or gradually reduced until either the vehicle is driven or the mass air flow of the engine reaches a predetermined value, whichever comes first. The engine RPM is then sensed and, if it is greater than the predetermined optimum RPM, the air/fuel ratio is made leaner. The technique of Auslander however results in an imprecise air/fuel control because the air inducted into the engine cannot be optimized for all operating conditions or fuels and this system can only be useful under predetermined conditions. Engine performance cannot be maintained for a variety of barometric operations, parasitic loads, fuels, or degradation of engine conditions. This process is also only useful for cold starts.

To best obtain a net enleanment condition in a cold engine start or generally any other operating situation, a reliable feedback system is required. Most enabling sensors available at this time, such as the Universal Exhaust Gas Oxygen (UEGO) sensor, are significantly expensive, require a significant warm up period of time, and are not completely reliable. Further, these sensors cannot determine the best enleanment possible on any given vehicle, generally because they only monitor the gases in the engine exhaust system. Fuel that is not utilized in the combustion process (also known as "lost" fuel) will incorrectly influence the exhaust sensor. These sensors are not considered robust enough to maintain control accuracy for the life of the vehicle and they are very sensitive to temperatures or chemical poisons.

SUMMARY OF THE PRESENT INVENTION

The general objective of the present patent is to allow for a method which will provide for an optimally maintained reliable feedback controlled air/fuel ratio of an engine during each of three phases: cold and warm starts, and idles, steady state cruise modes, and dynamic driving cycles. Each of these phases will have an incremental increase of complexity and capability.

In accordance with the invention, a method is provided for controlling an engine in a true feedback system to allow for fuel enleanment or enrichment depending upon which function is desirable. Generally, the method includes the step of sensing an engines' cylinder cycle—percentage of possible air charge, also known as a cylinder mass air charge or engine load value. This measurement and calculation of the load will generate a corresponding signal for use in the control system. The method also includes the step of comparing the measured cylinder mass air charge with a predetermined or learned desirable cylinder mass air charge to determine a cylinder mass air flow difference. The method further includes the step of determining a desired fuel control correction factor based on the cylinder mass air flow difference. Finally the method includes the step of controlling the engines air/fuel ratio based on the desired fuel control correction factor to enlean or enrich as desired. The quantity of fuel introduced will generally follow the power that is required from the engine and the air introduced will control the air/fuel ratio desired, by increasing or decreasing the cylinders' mass air charge. This process is often considered to be the opposite approach of typical operation, where the air is introduced into the engine, and the fuel is calculated to match. In further carrying out the above object and other objects, features and advantages of the present invention, a system is also provided to carry out the steps of the above described method.

The above object and other objects, features and advantages of the present invention are readily apparent from the following detailed description of each operating mode for carrying out the invention when taken in connection with the accompanying drawings.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
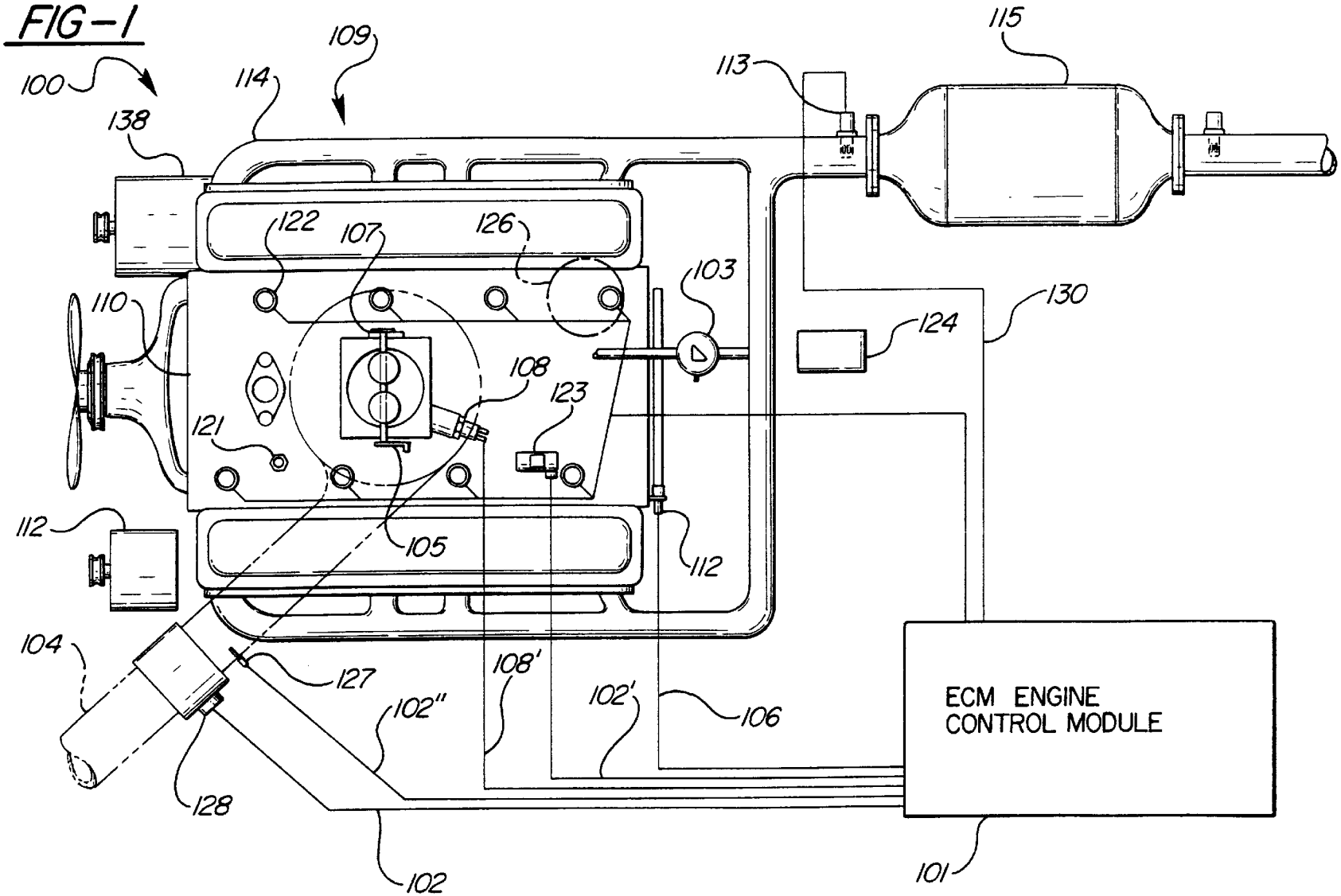
FIG. 1 is a schematic diagram of a typical vehicle engine and an electronic engine controller which embodies the principles of the present invention.

With reference to FIG. 1, there is shown at 100 a schematic diagram of the method and apparatus for maintaining an optimal air/fuel ratio according to the present invention. The system 100 as described in FIG. 1 includes an internal combustion engine 110 having an air intake system 104 and an exhaust system 109. An engine control module (ECM) 101 controls operation of the engine powertrain and is fed information from sensors position within the intake system 104. Namely, a conventional mass air sensor 128 is located within the air intake system 104 and feeds information to the ECM 101 along line 102. A manifold pressure sensor 123 communicates along line 102' for speed density air calculation systems. A barometric sensor 124 and/or a thermocouple 127 (connected to ECM 101 along line 102") may be required on some air/fuel control systems. The intake sensors 128, 123 and 124 are used to detect the amount of air mass inducted into the engine 110 indicative of a mass of air flowing into the induction system for receipt by ECM 101.

Referring again to FIG. 1, the system further includes other sensors for providing additional information about engine performance or air/fuel control to the ECM 101, these including crankshaft position sensor and angular velocity sensor can be one and the same and are connected to ECM 101 via line 106, throttle position sensor 107, engine coolant sensor 121, air conditioning enabled sensor 138, power steering system enabled sensor 117, transmission sensors. Also, a fuel injector is illustrated at 122. The information from these sensors is used by the ECM 101 to control operation of the powertrain.

The exhaust system 109 includes an exhaust manifold 114 and exhaust pipe, transports exhaust gas produced from combustion of an air/fuel mixture in the engine 110 to a catalytic converter 115. An upstream exhaust gas sensor 113 such as a heated exhaust gas oxygen sensor or UEGO, is positioned in or near the exhaust manifold, detects the relative oxygen content of the exhaust gas generated by the engine 110 and transmits a representative signal 130 to the ECM 101. The oxygen sensor 113 will provide a signal having a high state when the air/fuel ratio of operation is on the rich side of a predetermined air/fuel ratio commonly referred to as stoichiometric (about 14.7 lb. of air/one lb. of a specific gasoline sample as used in this example) and a low state when the air/fuel ratio is lean of stoichiometric. A UEGO will provide a relative signal to the net air/fuel of the combusted mixture.

Further, the system of FIG. 1 includes a primary throttle mechanism 105, and a secondary throttle mechanism 108 also possibly known as an idle air control (IAC) valve and communicates with the ECM 101 via a further line 108'. If, during a mode such as a cold start, it is determined that a fuel enleanment is desired, the engine will require additional air to obtain the enleanment condition while still allowing a desired power output from the engine system. The IAC 108 will be opened by the ECM 101 to allow more air into the engine while reducing the fuel proportion of the air/fuel mixture being induced into an engine cylinder 126. The Primary throttle 105 will be operated by the vehicle operator or in more complex "drive by wire" systems to be actuated by the ECM 101 to maintain the desired power output from the powertrain.

A target cylinder air charge or mass air load value, to operate controlled lean, generally is greater than that which is normal for an engine operating at stoichiometry. This value is initially programmed into the ECM 101 for standard speed-load conditions where fuel enleanment is desired. This load value can be a simple adder to normal loads and/or a ratio of normal loads. A load is defined as the percentage of total air introduced into a single cylinder event divided by the total possible air capacity of a cylinder event. The air introduced into a cylinder is defined as the total amount of air introduced into an engine in a given time period divided by the number of cylinder events during that time period. This value can be a pre-programmed value or the value can be learned by the ECM 101 while operating under conventional closed loop stoichiometric operation also known as the learning mode and as will be further described in FIG. 4. The values used for idles would be a function of engine coolant temperature and time since start-up of the engine with any desired load adders such as transmission engagement or air conditioning compressor usage, alternator load, or power steering pump while enabled, being considered. Using a proportional-integral-derivative (PID) controller which is well known to the art, the air/fuel ratio delivered to the engine is adjusted to maintain the desired target load value.

A maximum or minimum air/fuel or load clip limit would also be calibrated to prevent an excessively rich or lean operation or general error. Alternatively, the mathematical second derivative of the commanded control value while operating lean will allow for a considerable control ability before excessive enleanment is reached. In this example, if the second derivative value is above a predetermined number, the target load value is decreased. The signal from the EGO or UEGO 113, when possible, would be monitored for any undesirable operation. In this example, a high signal from the EGO indicating rich, while a lean operation is desired, would indicate a learning mode or error detection mode should be entered.

Figure 2:
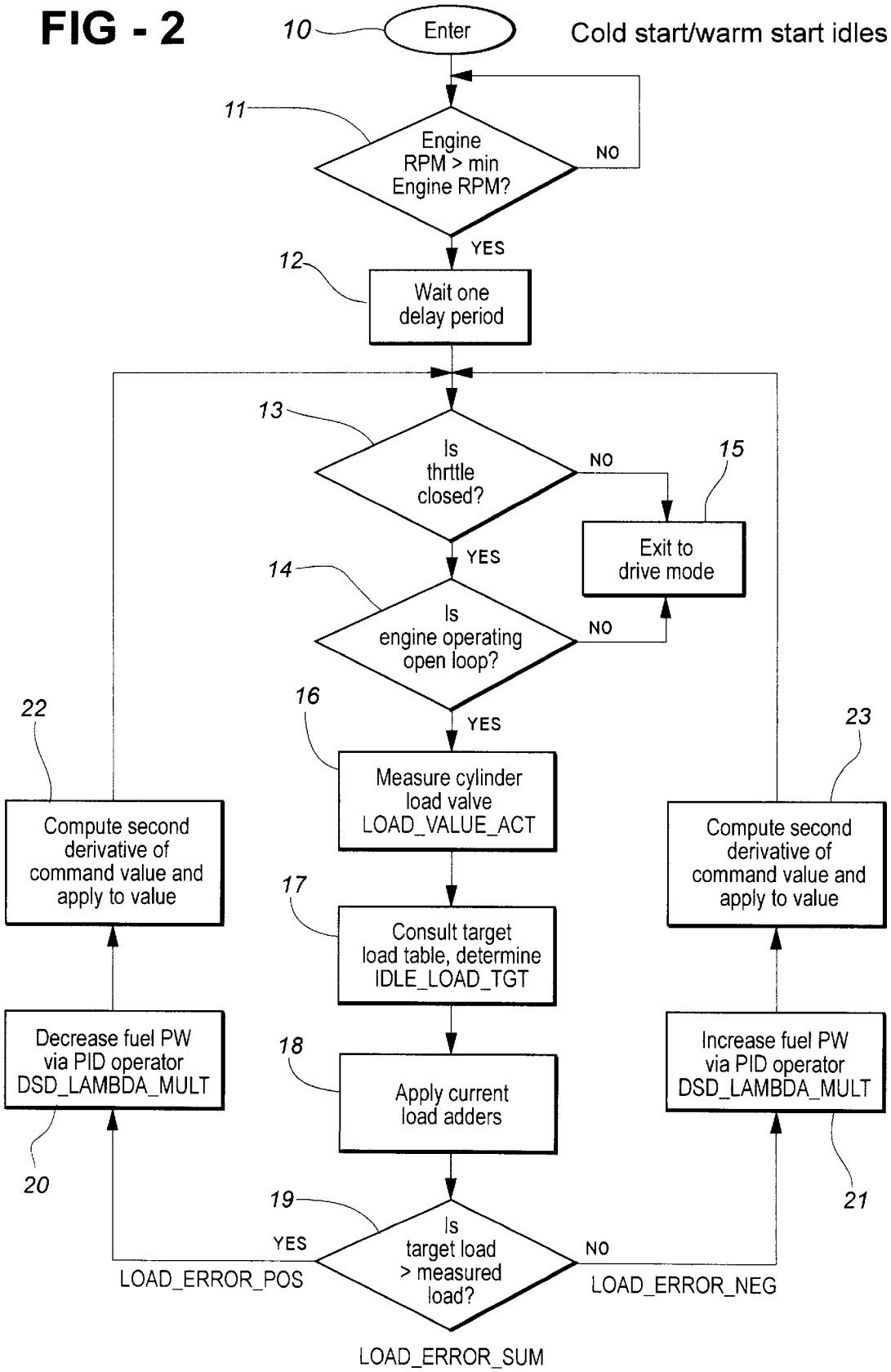
FIG. 2 is a flowchart illustrating a preferred embodiment of the general sequence of steps associated with the operation of the present invention while operating at a cold or warm start and idle.
Figure 3:
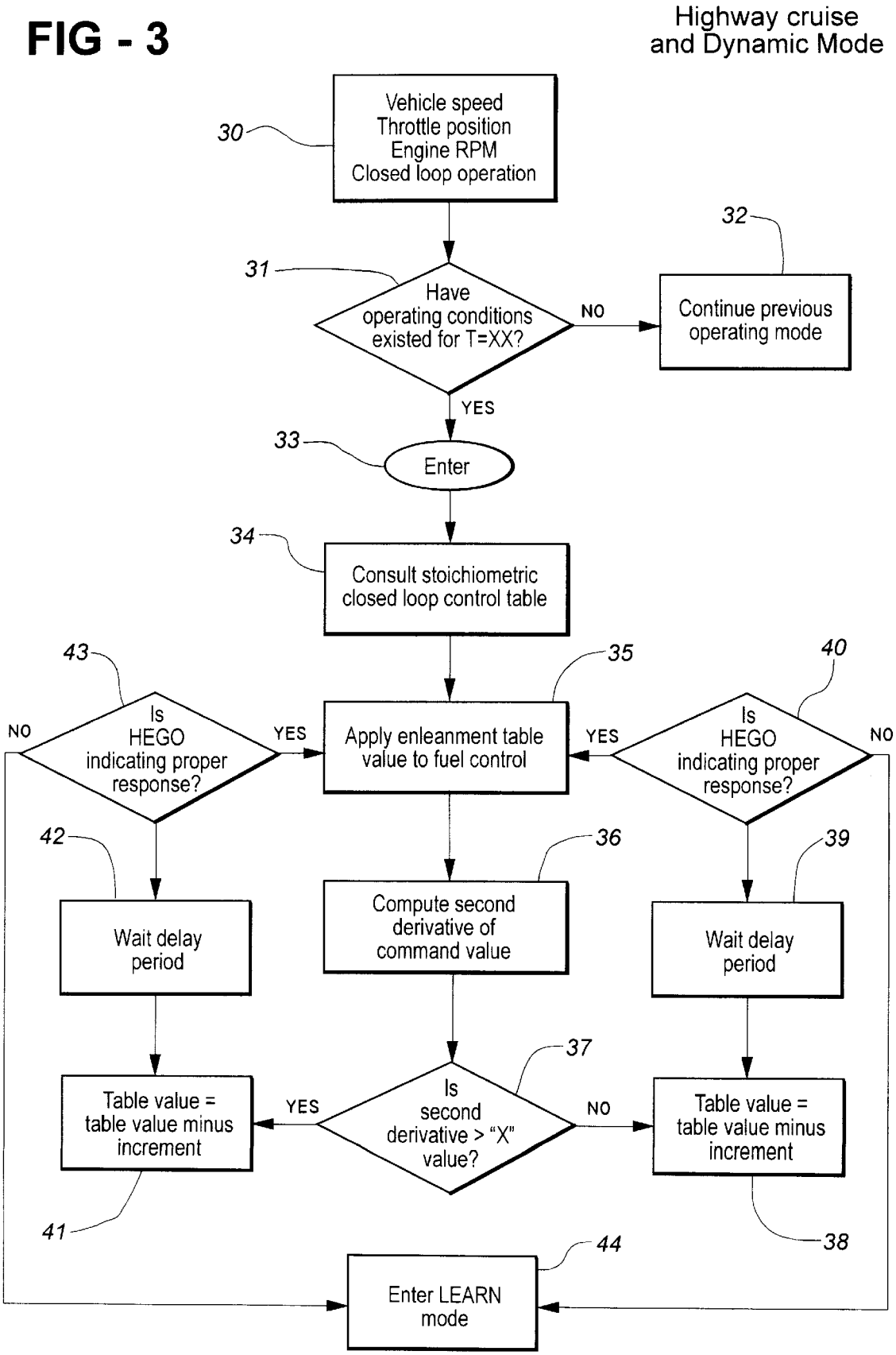
FIG. 3 is a flow chart illustrating a preferred embodiment of the general sequence of steps associated with the operation of the present invention while operating at a steady state or vehicle cruise mode and also with appropriate entry conditions-dynamic control mode.
Figure 4:
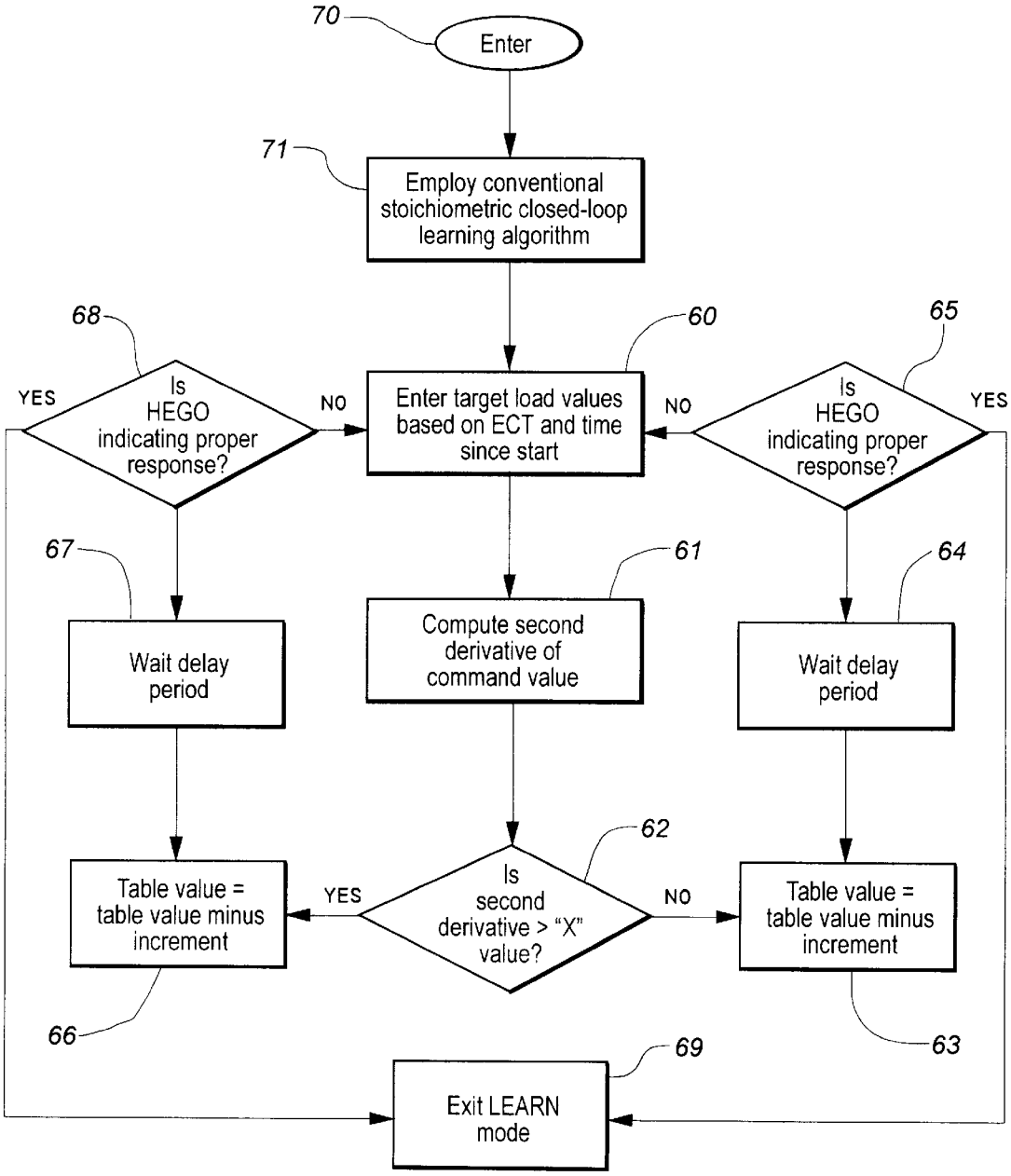
FIG. 4 is a flow chart illustrating a preferred embodiment of the general sequence of steps associated with the operation of the present invention while operating in a learning mode.

Referring further to FIGS. 2 through 4, flowcharts are illustrated of the steps in routine performed by a control logic, or ECM 101. The ECM may be comprised of hardware, software or a combination thereof. Although the steps shown in FIGS. 2 through 4 are depicted sequentially, they can be implemented utilizing interrupt-driven programming strategies, object oriented programming, or a suitable substitute.

In a preferred embodiment, the steps shown in FIGS. 2 through 4 comprise a portion of a larger routine which performs other engine control functions. Referring first to FIG. 2, it shows the steps in the fuel enleanment control routine performed by the ECM 101 to maintain the desired net enleanment true feedback control condition during engine cold-starting and warm-starting operations.

Before entering the system 10 of the present invention, a check is made to determine whether or not a set of predetermined entry conditions have been met at step 11. The predetermined conditions may include, but are not limited to, the time since start being greater than a predetermined value, engine coolant or air temperature being within a suitable realm, current and correct throttle position or transmission use, etc. Once the predetermined entry conditions have been met, the method proceeds to determine which mode of operation is desired and if the entry conditions for each mode have been met.

MODE "1", the cold or warm start and idle mode

The first mode to be described is the cold start or warm start including engine idles, mode as shown in FIG. 2. This mode is the simplest mode to calibrate and operate. This mode is also the most useful and the best mode to use, if desired, all by itself. The predetermined entry conditions may include time since exit of engine cranking into an engine running condition is greater than a predetermined period of time 12. For this example, a value of one second may be useful. The engine RPM value should be within a realm of the predetermined values 11, and the primary throttle 105 (see FIG. 1) should be closed at step 13. The ECM 101 must also command typical open loop control to enter this example at step 14. The secondary throttle also known as a idle air control motor, IAC 108 (FIG. 1) will be operated by the ECM 101 to maintain a predetermined desired engine speed based on inputs to the ECM such as, time since start and engine coolant temperature.

Step 13 queries if the throttle is closed and step 14 successively queries whether the engine is operating in open loop fashion. If no is answered to either query, the process exits to drive mode at step 15. If yes, the method would then proceed to measure the actual cylinder load value at step 16 to obtain LOAD_VALUE_ACT and then determine a desired target cylinder mass air charge at step 17 IDLE_LOAD_TGT value. The target engine load value IDLE_LOAD_TGT is a predetermined calibratable variable which is found by an index of a table of engine load values as a function of time since start and engine coolant temperatures with additional load value adders at step 18 indexed to transmission operation, air conditioning and other engine parasitic loads, if desired, or a value learned in Mode "3" FIG. 4 of the learning mode.

At step 19, the instantaneous difference would be entered into the proportional calculation section of the PID controller at blocks 20 and 21. This value is a predetermined fraction of the total difference. The Integral value would be obtained as a cumulative error with respect to time, and inputted into a cumulative ECM register, LOAD_ERROR_SUM. This register would be updated by a periodic timer which would increment LOAD_ERROR_POS or decrement LOAD_ERROR_NEG the error sum value based on the current target value error. A derivative value would be useful, although not necessary, to stabilize the commanded engine load value and predict a better lock-in of engine load. A second derivative of the resulting commanded control would be monitored to determine if excessive de-stabilization has been commanded, with a decrease in target load—resulting if this determination has in fact occurred in blocks 22 and 23 which each compute second derivatives of command values and apply to the value and as also described in FIG. 4.

The composite value which is the sum of the PID controller logic would result in a fuel correction factor DSD_LAMDA_MULT (at steps 20 and 21). In this example, if the desired target load IDLE_LOAD_TGT was higher than the current measured engine load value LOAD_VALUE_ACT, the resulting DSD_LAMDA_MULT would be a negative fuel multiplier, which would cause progressive enleanment (step 20). Meanwhile, the ECM 101 would monitor the engine RPM value, and as the additional fuel is taken away, the engine RPM value would tend to decrease, which would cause the ECM to command a secondary throttle, also known as the Idle Air Control motor IAC 108 (see again FIG. 1) opening, to maintain the desired engine speed. The opening of the secondary throttle would increase the cylinder air charge value LOAD_VALUE_ACT also known as engine load value to achieve the desired target IDLE_LOAD_TGT. If at any time, the engines— performance degraded, the engine RPM would decrease. In an example, if the throttle positions were to remain in a static position, or, be commanded to open further by the ECM, the actual engine load value LOAD_VALUE_ACT would increase to the point where the value would ultimately exceed the desired engine target value IDLE_LOAD_TGT. Thus, the target engine load value would be lower than the current measured engine load value, and the ECM 101 would command an enrichment to the fuel correction factor.

The DSD_LAMDA_MULT would be limited in the range of authority, so over enrichment or over enleanment errors cannot occur. If these values were exceeded, an exit to standard fuel control and learning mode 44 (see again FIG. 4) would be commanded.

While the system is operating in the cold start or warm start mode the ECM 101 will determine if the time since entry to the starting mode exceeds a predetermined calibratable value. In this example, it may be desired for the vehicle to enter a typical closed-loop, stoichiometric mode 15 for standard operation where the EGO or UEGO 113 are in a suitable operating condition, or, to enter the learning mode. If the ECM 101 detects any event which may cause an error to occur or the vehicle operator actuated the primary throttle, the controller would exit the cold or warm start idle mode.

Mode "2", the optional steady state cruise or highway mode

Discussions on value and use:

The purpose of mode "2" is to obtain the best highway fuel economy and lowest emissions possible. This is described in FIG. 3. The best fuel economy is usually found in a region of air/fuel ratios near 20 to 30% lean (Lambda= 1.2 to 1.3). The actual best lean limit is a function of the engine properties and fuel used. Again, in typical air/fuel control systems, a closed—loop control system is desirable, however the sensors which are available to enable a closed—loop control system, such as Exhaust gas sensors (at 113 in FIG. 1), generally are not useful in a net enleaned air/fuel control system.

Further, in the higher load regions characteristic of the Highway cruise mode, regulated emissions of Nitric Oxides (NOx) are prevalent, and a method used to mitigate the Oxides of Nitrogen is called Exhaust Gas Recirculation EGR 103. EGR is used because it dilutes the combustion mixture with a somewhat inert gas which will increase the total cylinder gas mass. This larger mass, with a static level of energy input from the combustion of the air/fuel mixture, will cause a lower overall peak temperature to be reached. The peak temperature reached has a direct relationship to the mass of NOx produced. Therefore, a reduction in peak temperatures, will result in a reduction of NOx production. A short-coming associated with larger quantities of EGR needed, is the production of regulated Hydrocarbons in the internal combustion process mostly caused by slow ignition or miss-fires. This increase in Hydrocarbons is significantly a result of the greater average distance between the fuel molecules in the combustion process and the availability of nearby oxygen molecules. This is a direct relationship caused by the dilution with EGR. This process will allow for thermal dilution without an increase in the average distance of said molecules, resulting in increased stability.

The present invention will allow an increase in air to be added while maintaining a true feedback air/fuel control. This process will allow a enleaned air/fuel mixture in the desired Lamda region to obtain the best fuel economy, and, eliminate the need for a typical EGR system with it's related cost and problems because the air/fuel mixture is diluted with a larger mass of air. The partial pressure of Oxygen will be increased while the distance between the fuel molecules and the Oxygen molecules will be decreased. In this example, fuel economy will be maximized, and regulated emissions will be minimized.

The entry into Mode 2, FIG. 3, is preceded by analysis of the vehicle operation. To enter cruise mode the vehicle speed, engine rpm, transmission operation, and other conditions at step 30 must be met for a period of time (step 31) which would indicate proper and desired cruse conditions. Step 31 will query if operating conditions have existed for a specified period of time and, if not, step 32 instructs the continuance of the previous operating mode for a further period of time. If the quiery of step 31 is yes, the process enters at step 33.

The predetermined typical closed-loop fuel control table will have corrected values which would allow for a very close to stoichiometric air/fuel operation if the ECM 101 commands open-loop operation at step 34. The airflow into the engine is measured and an offset from the stoichiometric fuel table is applied in logic block at step 35 which queries whether to apply the enleanment table value to fuel control. The second derivative of the command fueling is calculated at step 36 to deter mine if excessive control instability is evident at step 37, with the difference from an ideal value determined. The commanded air/fuel ratio is modified at blocks 38 and 41 and a short period of time is elapsed, at steps 39 and 42, respectively, to allow the control functions to be executed and analyzed (namely whether the exhaust gas sensor is indicating proper response at 40 and 43). If an incorrect result is detected, an error is flagged, and the system will exit to a learning mode as shown in block (44). If a correct result is detected, the process will proceed to step 35 for a further iterative cycle.

Mode "3", Dynamic control, with Learning mode

Discussions of value and use:

Mode "3" is the most involved control system in actual dynamic complexity and may have the least impact on fuel economy and regulated emissions except for alternative reasons, as listed below. This is because typical closed-loop feedback control, has evolved to the point where fuel economy is very reasonable and regulated emissions are close to zero when used with an adequate exhaust gas after-treatment system such as a catalyst. Because the correct fueling in this mode is very hard to track due to the engine dynamics, the second derivative calculation process is heavily relied upon. This mode is considered optional, although the learning portion of this mode has desirable interactions with mode "1"+"2". The dynamic mode can be utilized with any period of operation which is significantly not considered steady state vehicle operation which are covered with Modes 1 and 2. An urban driving cycle is considered typical of the dynamic mode. Wide open throttle operation is not usually considered to be part of the enleanment process as rich operation is usually allowed for power and better engine thermal protection. The logic for mode "3" is identical as that for mode "2" except for the weighting of the identified components of this mode.

Alternate uses of this mode and of the other modes become evident in situations where an exhaust system is always desired to be kept cool. These examples include but are not limited to uses in marine engines, or conditions where high temperatures are not desired such as in mine vehicles or other confined engine uses, or any other place that flammable or explosive conditions may be present. Uses which cannot utilize HEGO's are considered proper uses for Mode "3". Further, areas of the world where the analysis of absolute minimum of exhaust emissions or fuel economy are not required or where financial value judgments are made which do not favor an expensive typical feedback system would be suitable markets. Even jet and diesel engines would benefit from this process.

The learning mode (FIG. 4) consists of a period of data acquisition with reference to conventional engine speed-load point operations during stoichiometric closed-loop driving cycles (see step 71 which employs conventional stoichiometric closed-loop learning algorithms) and following entry step 70. Fuzzy logic would enable this process greatly. The typical engine load values while operating in standard closed-loop operation are determined while dynamic driving conditions exist. In this operation a tabular learning process is executed, with relationships to the throttle position, engine speed, cylinder load value, and indexed to standard operating temperatures. These values are stored in the non-volatile memory of the ECM 101 as normal corrections to the stoichiometric fuel control tables with the desired load adders applied as needed when operating in the desired mode of this invention at step 60.

The second derivative of the control function is analyzed (step 61) to determine the stability of the fuel control. The computed second derivative of the command value is compared to a target value (step 62) and the resulting difference, if greater than the specified value, is used to increment (at step 66) or, if lesser than the specified value, to decrement (at step 63) the overall target table values to better targets. A delay period (step 64 and 67, respectively) is entered to allow a restorability of control functions to occur. An analysis of exhaust gas sensor voltage output is evaluated for proper function (steps 65 and 68) and, if so, ultimately allows an exit from the learning mode at step 69. If not, the process repeats back to step 60 in reiterative fashion.

Having described my invention, it will become apparent that it discloses a method and apparatus for controlling a fuel delivery rate at which fuel is supplied to a fuel intake of an internal combustion engine in closed loop control fashion and which is an improvement over the prior art. Additional preferred embodiments will become evident to the those skilled in the art to which it pertains without deviating from the scope of the appended claims.

What is claimed is:

1. A method of controlling the fuel delivery rate at which fuel is supplied to the fuel intake of an internal combustion engine while the engine is operating at a desired angular speed, said method comprising, in combination, the steps of:

measuring a quantity of air being inducted into the internal combustion engine and then processing a resulting signal to determine a measured engine load value;

comparing said engine load value with a table of desired engine load values to produce an indication of when said load value is either less than or greater than a desired value;

responding to an onset of each indication of a load value greater than that desired by increasing fuel delivery to the engine intake until the load value is equal to or less than said desired load value; and responding to an onset of each indication of a load value less than that desired by decreasing fuel delivery to the engine intake until the load value is equal to or greater than said desired load value.

2. The method set forth in claim 1, comprising the further step of increasing the fuel delivery to the engine intake in a stepwise manner proportional to a difference between said measured load value and said desired load value.

3. The method set forth in claim 1, comprising of the further step of increasing the fuel delivery to the engine intake in an increasing manner relating to a time based relationship of the continuing difference between said measured load value of said engine and said desired load value of said engine.

4. The method set forth in claim 1, comprising the further step of decreasing the fuel delivery to the engine intake in a stepwise manner proportional to the difference between said measured load value and the desired load value.

5. The method set forth in claim 1, comprising the further step of decreasing the fuel delivery to the engine intake in a decreasing manner relating to a time based relationship of the difference between said measured load value of the said engine and said desired load value of the engine.

6. The method set forth in claim 1, comprising the further step determining a rate of closure of the difference between said measured load value and said desired load value and adjusting an additional fuel delivery rate based on said rate of closure.

7. The method set forth in claim 1, comprising the further step of determining a numerical value mathematically of a second derivative of a commanded control variable and so as to determine a commanded control stability factor.

8. The method set forth in claim 7, comprising the further step of determining a difference in said numerical value of said second derivative from a target value, whereas said resulting difference is used to adjust said desired load value used.

9. The method set forth in claim 1, comprising the further step of measuring the engine's angular velocity to produce a speed signal, means for determining an air intake rate into the engine to develop a current load signal, and means for changing said air intake to maintain a desired engine velocity.

10. The method set forth in claim 9, comprising further the step of introducing an increased air flow intake into the engine when the angular velocity is less then a predetermined desired value.

11. The method set forth in claim 9, comprising further the step of decreasing an air flow intake into the engine when the angular velocity is greater than a predetermined desired value.

12. The method set forth in claim 1, comprising further the step of entering a controlled Stoichiometric air/fuel control.

13. The method set forth in claim 12, comprising further the step of measuring engine load values while in typical operation and generating plural values which are stored in a memory and using said stored values in combination with value adders and multipliers to produce new optimized operating desired load targets.

14. The method set forth in claim 13, comprising further the step of responding to a magnitude of the difference between said new desired load values and said currently measured load values.

15. The method set forth in claim 1, comprising further the step of maintaining a closed loop control of said fuel delivery rate until a predetermined command exit is requested.

16. A system for providing an optimally maintained feedback controlled air/fuel ratio of an internal combustion engine during multiple operating phases, the engine including an air intake, a plurality of fuel injectors supplying individual cylinders, and an air exhaust, said system comprising:

an engine control module;

a plurality of intake sensors located within the air intake and connected to said engine control module for determining an engine load value representative of a percentage of possible air charge into a cylinder of the engine;

an exhaust gas sensor located within the exhaust prior to a catalytic converter and providing a signal to said engine control module representative of a rich air/fuel ratio or a lean air/fuel ratio as compared to a desired air/fuel ratio;

said engine control module determining a desired fuel control correction factor based upon a measured difference between said representative rich or lean air/fuel ration and said desired air/fuel ratio; and an idle air control valve responsive to an output signal of said engine control module to adjust said engine load value.

17. The system according to claim 16, said intake sensors further comprising a mass air sensor and a manifold pressure sensor.

18. The system according to claim 17, said intake sensors further comprising a barometric sensor, a crankshaft position sensor, an angular velocity sensor, a throttle position sensor, an engine coolant sensor and an air conditioning enabled sensor.

19. The system according to claim 16, the multiple operating stages of the engine further comprising a cold start stage or warm start stage, an idling stage, a steady state cruise stage, and a dynamic driving cycle stage.

* * * * *